US009175495B1

(12) United States Patent
Bruyn

(10) Patent No.: US 9,175,495 B1
(45) Date of Patent: Nov. 3, 2015

(54) GRAVE STONE MARKER WITH PROTECTED VIEWING CHAMBER

(71) Applicant: Izak Du Bruyn, Fort Lauderdale, FL (US)

(72) Inventor: Izak Du Bruyn, Fort Lauderdale, FL (US)

( * ) Notice: Subject to any disclaimer, the term of this patent is extended or adjusted under 35 U.S.C. 154(b) by 0 days.

(21) Appl. No.: 14/228,637

(22) Filed: Mar. 28, 2014

(51) Int. Cl.
*E01F 9/011* (2006.01)
*E04H 13/00* (2006.01)
*A61G 99/00* (2006.01)

(52) U.S. Cl.
CPC ..... *E04H 13/003* (2013.01); *A61G 99/00* (2013.01); *E04H 13/00* (2013.01)

(58) Field of Classification Search
CPC ..... E04H 13/003; E04H 13/00; E04H 13/006; E04H 13/008; A61G 17/08; A61G 1/12; A61G 1/0655
USPC ..... 52/103, 104, 128, 134–137, 139, 140
See application file for complete search history.

(56) References Cited

U.S. PATENT DOCUMENTS

| | | | | |
|---|---|---|---|---|
| 1,274,809 | A * | 8/1918 | Storm | 52/104 |
| D89,766 | S * | 5/1933 | Hull | D99/17 |
| 3,438,159 | A | 4/1969 | Bergener | |
| 4,790,088 | A | 12/1988 | Morvant | |
| 5,732,515 | A * | 3/1998 | Rodrigues et al. | 52/103 |
| 5,787,625 | A * | 8/1998 | Yesbick | 40/718 |
| D436,758 | S * | 1/2001 | Rodrigues | D6/470 |
| 6,526,636 | B2 * | 3/2003 | Bernhardt | 27/1 |
| 6,980,107 | B1 | 12/2005 | Ziegler | |
| 7,089,495 | B2 | 8/2006 | Barrows | |
| 7,191,499 | B2 * | 3/2007 | Davis et al. | 27/1 |
| 8,068,035 | B1 * | 11/2011 | Salcedo et al. | 340/691.1 |
| 8,499,425 | B2 * | 8/2013 | Roberts | 27/1 |
| 8,595,969 | B1 * | 12/2013 | Wheelis et al. | 40/768 |
| 8,763,318 | B1 * | 7/2014 | Bobbitt | 52/103 |
| 2001/0025459 | A1 * | 10/2001 | Barnes | 52/103 |
| 2001/0036354 | A1 | 11/2001 | Majors | |
| 2006/0236326 | A1 * | 10/2006 | Aguirre | 719/322 |

* cited by examiner

*Primary Examiner* — Phi A
*Assistant Examiner* — Omar Hijaz
(74) *Attorney, Agent, or Firm* — Malin Haley DiMaggio & Bowen, P.A.

(57) ABSTRACT

A gravestone marker that includes a viewing chamber for receiving photographs and other small objects such as memorabilia honoring the deceased that includes a cement base frame with a hollow interior of a predetermined size and shape for placing on a concrete slab above the grave of the deceased, and a sheet of transparent bulletproof material that can be glass or plastic permanently attached by concrete epoxy adhesive to the concrete base frame forming a chamber beneath the transparent sheet. The chamber can receive photographs and other objects that can be viewed by persons standing at the gravesite. The strength of the transparent sheet of material can prevent vandalism or theft at the gravesite.

3 Claims, 6 Drawing Sheets

GRAVE STONE MARKER WITH PROTECTED VIEWING CHAMBER

BACKGROUND OF THE INVENTION

1. Field of the Invention

This invention relates to grave stone markers that may include granite, and specifically to a gravestone marker that includes a protected viewing chamber for photographs and small objects.

2. Description of Related Art

The use of gravestone markers to honor the memory of persons who have passed away, especially family members, using granite or other stone is well known in the prior art. While a granite tombstone or gravestone marker that is engraved with information is a time enduring memorial, it would be desirable to include memorabilia in addition to the tombstone to honor the love one that has passed away. For example it would be desirable to provide photographs and perhaps other small objects and memorabilia at the grave site that could remain there perpetually as long as the gravesite is there.

The invention described in this patent application accomplishes these objectives by providing a granite gravestone marker that includes a protected viewing chamber that includes a clear transparent cover of bulletproof material either glass or acrylic. The protected viewing chamber is also weatherproof, waterproof and moisture proof.

SUMMARY OF THE INVENTION

A grave stone marker comprising a cement or concrete slab base mountable on the ground at the grave site, a concrete first base having a hollow interior, the inside periphery of the interior having a supporting ledge for supporting a glass panel, a second thinner walled frame made of granite that is adhesively attached on top of said first base concrete frame. A translucent clear sheet or panel of bullet proof glass or plastic is adhesively mounted on the concrete base frame support ledge, and mounted and firmly attached also by adhesive to said granite frame forming a chamber with said concrete base, said granite frame and the glass sheet.

The protected viewing chamber is large enough to receive small objects of memorabilia and photographs that can be positioned in a secure chamber that can be viewed by a person standing next to the gravesite.

The bulletproof glass protective sheet that is translucent is sized and shaped to fit snugly in the granite frame and on top of the concrete base support ledge around its edges with water proof concrete epoxy adhesive. The glass sheet can also be attached to the granite frame with other waterproof adhesives.

The granite frame is secured to the concrete or cement base with concrete epoxy adhesive giving the granite frame strength and heavy-duty weight. The cement frame is anchored into a concrete slab in the earth by drilling holes into the slab and using rebar projections extending from the very base or bottom surface of the concrete frame so that the concrete frame is permanently attached using concrete adhesive and rebar to a slab at the grave site.

It is an object of the invention to provide an improved gravestone marker such that it has a protected viewing chamber that is protected from the outdoor environmental harsh elements and vandalism.

It is another object of the invention to provide a gravestone marker that allows relatives and friends the ability to view memorabilia and photographs at a gravesite into a viewing chamber that is permanently accessible outdoors.

PREFERRED EMBODIMENT OF THE INVENTION

Figure 1:
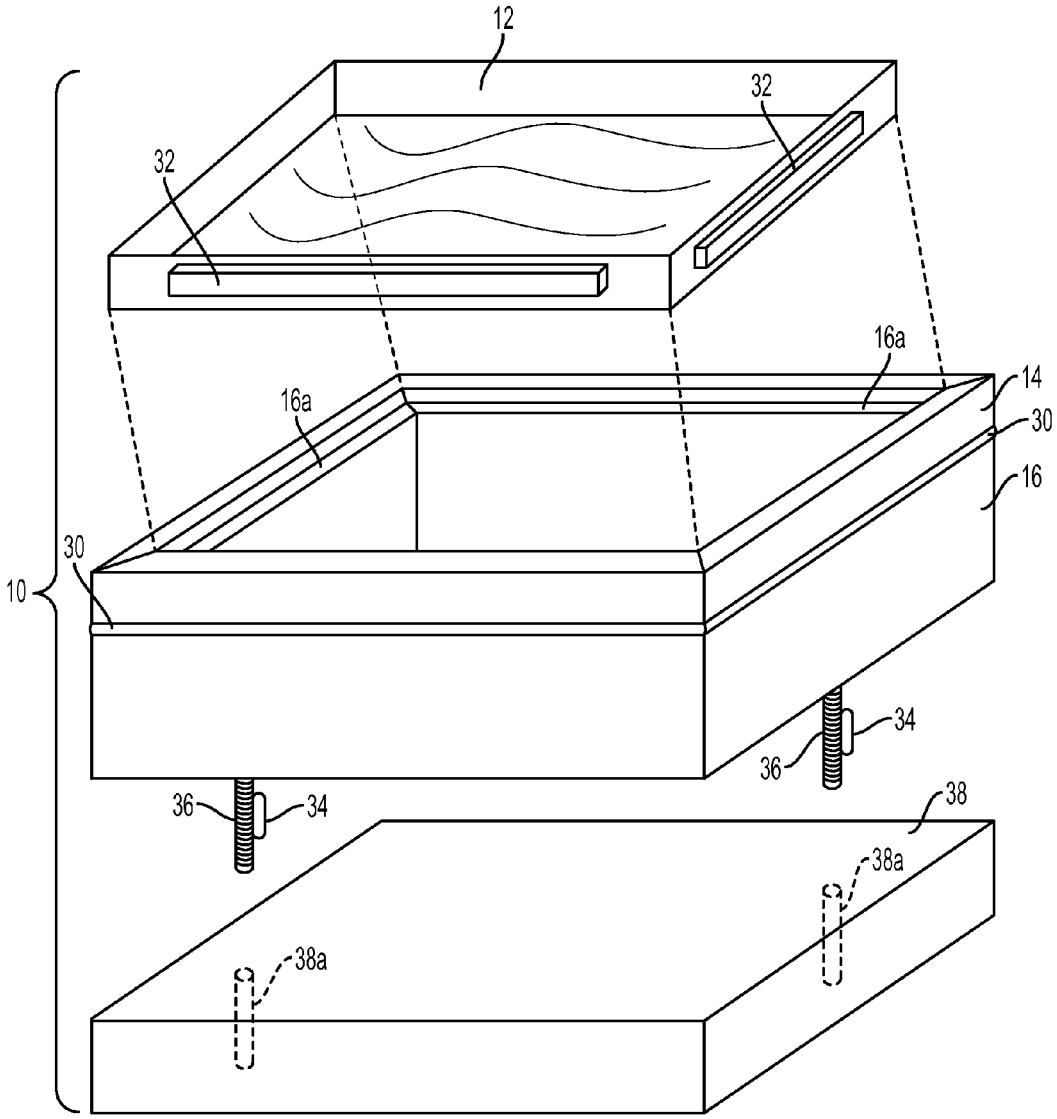
FIG. 1 shows a perspective exploded view of the gravestone marker with protected viewing chamber and concrete slab.

Referring now to the drawings, and in particular FIG. 1, the gravestone marker 10 is shown with a protected viewing chamber in an exploded view comprising a rectangular sheet of glass or acrylic display window 12 that is transparent and optically clear that is permanently attached to a concrete base frame 16 by concrete epoxy adhesive 32 and a granite frame 14 mounted and connected to the cement base frame 16 by concrete epoxy adhesive 30. The concrete base frame 16 is permanently anchored to a concrete slab 38 located at the exact gravesite using adhesive and a plurality of rebar fasteners 36 placed in holes 38 *a* in the concrete slab 38 along with adhesive epoxy 34. Additional up epoxy adhesive and sealant could also be disposed between the contact surfaces of concrete base frame 16 and portions of the upper surface of slab 38. The display window 12 is also attached to the granite frame 14 with concrete epoxy adhesive 32. The concrete base frame 16 includes an upper surface ledge 16*a* that supports glass display window 12 when it is adhesively attached to the ledge 16*a* by epoxy adhesive. Before the person responsible for the gravesite permanently installs glass display window 12, the person responsible manually inserts memorabilia in the form of one or more photographs and other small objects into the chamber formed by concrete slab 38 concrete base frame 16, and granite frame 14. Once the person responsible has placed all of the memorabilia that will form part of the memorial permanently, the person responsible will direct the gravesite workers to permanently install the display window 12 which is inserted and rests on concrete base frame ledge 16*a*.

The concrete base frame 16 is rectangular and has an open interior. The concrete base frame 16 is mounted on a concrete slab 38 or other structure at the cemetery gravesite. The invention described herein is suitable to use in a cemetery where caskets are typically buried underground. The concrete slab 38 can be located were ever desired relative to a specific gravesite. The rectangular concrete base frame 16 forms a chamber with the top of the slab 38. The granite frame 14 which is firmly attached to the top surface of the concrete base frame 16 is sized and shaped to receive the display window 12 that is firmly attached by epoxy adhesive inside the granite frame 14 and resting on concrete base frame ledge 16*a* as a permanent installation.

The concrete base frame 16 has a plurality of cylindrical rod-shaped rebar fasteners 36 projecting vertically from the bottom face of concrete base frame 16. The cylindrical fasteners 36 are sized to fit into holes 38*a* that have been drilled in a concrete slab 38. Concrete epoxy adhesive 34 is applied around the cylindrical rebar fasteners 36 to firmly and permanently attach the concrete base frame 16 to the slab 38. The concrete base frame bottom surface can also be attached to the top surface of slab 38 using concrete epoxy adhesive in addition to the cylindrical rebar fasteners.

However before the bulletproof glass display window 12 is manually put in place with concrete epoxy adhesive, and mounted to the concrete base frame 16 and granite frame 14, memorabilia such as photographs and other small objects to honor the deceased are placed within the concrete frame 16 hollow interior that forms a chamber with concrete slab 38 top surface. The display window is then attached with adhesive to the granite frame 14 and the concrete base frame 16. The memorabilia can be viewed through the display window 12 once in place. The glass material for the display window is made of a durable glass or acrylic plastic that can be bulletproof, waterproof and hermetically sealed to protect the photographs and other objects placed in the receptacle 16.

Figure 2:
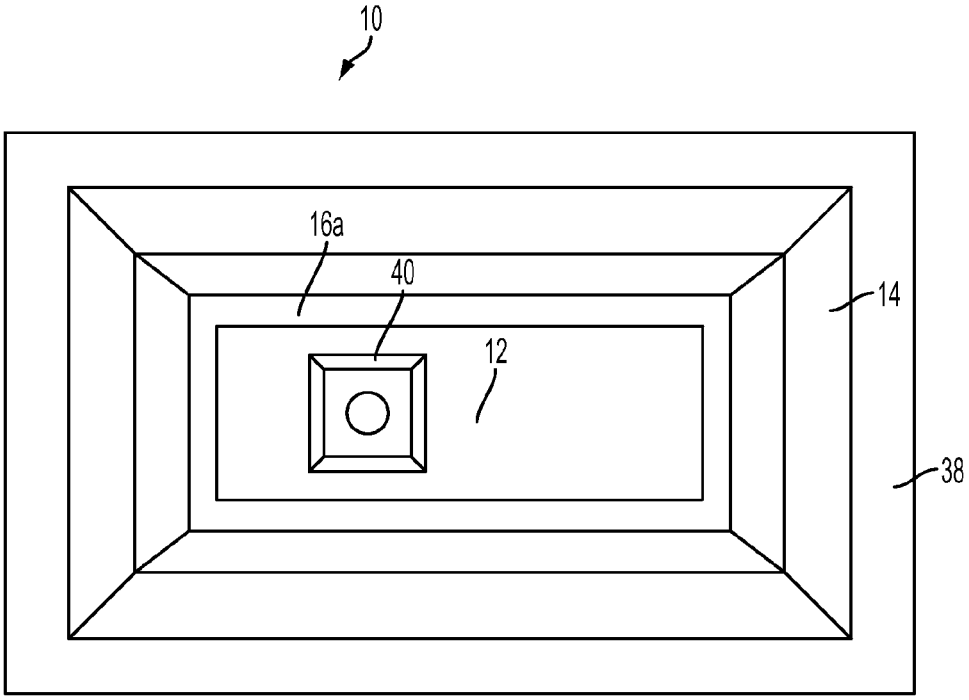
FIG. 2 shows a top plan view of the invention shown in FIG. 1.

FIG. 2 shows a top plan view of the gravestone marker 10 showing a picture frame 40 that could be a photograph and other memorabilia that can be seen looking down through the display window 12. The display window 12 is shown firmly mounted to the granite frame 14 which may include beveled edges in the granite work. The concrete slab 38 is visible. Also the concrete base frame support ledge 16 is shown supporting the display window 12 which has been adhesively attached to the concrete frame support ledge 16*a* and granite frame 14.*a*

Figure 3:
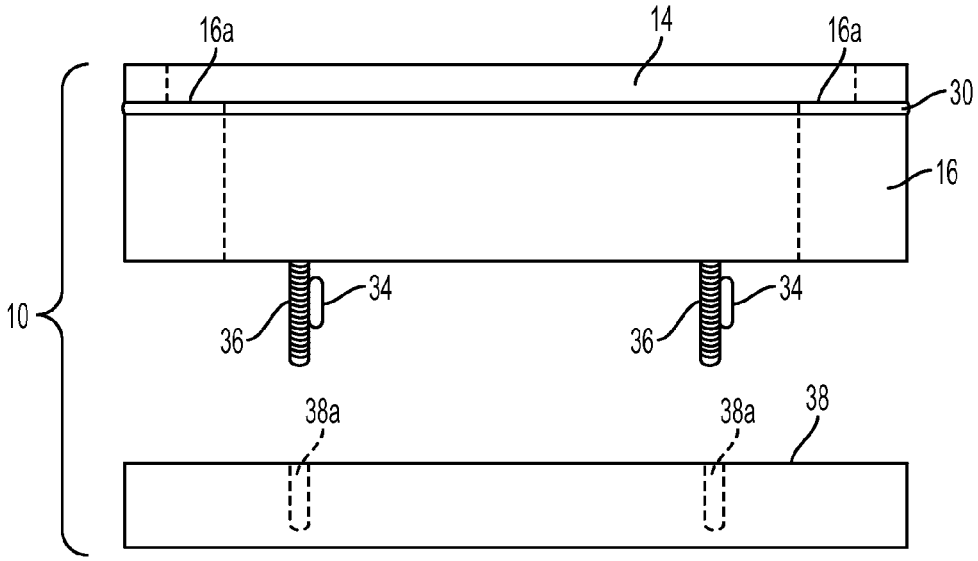
FIG. 3 shows a side elevational view of the invention shown in FIG. 1.

Referring now to FIG. 3, a side exploded view of the gravestone marker 10 is shown that discloses the concrete base frame to 16 firmly attached by concrete epoxy adhesive 30 above and on top of the granite frame 14. In the view in FIG. 3, the display window 12 is not visible. The concrete slab 38 is shown that includes holes 38*a* that receive cylindrical rebar fasteners 36 projecting out of the bottom surface of concrete base frame 16 and concrete epoxy adhesive 34 to attach fasteners 36 to slab 38.

Figure 4:
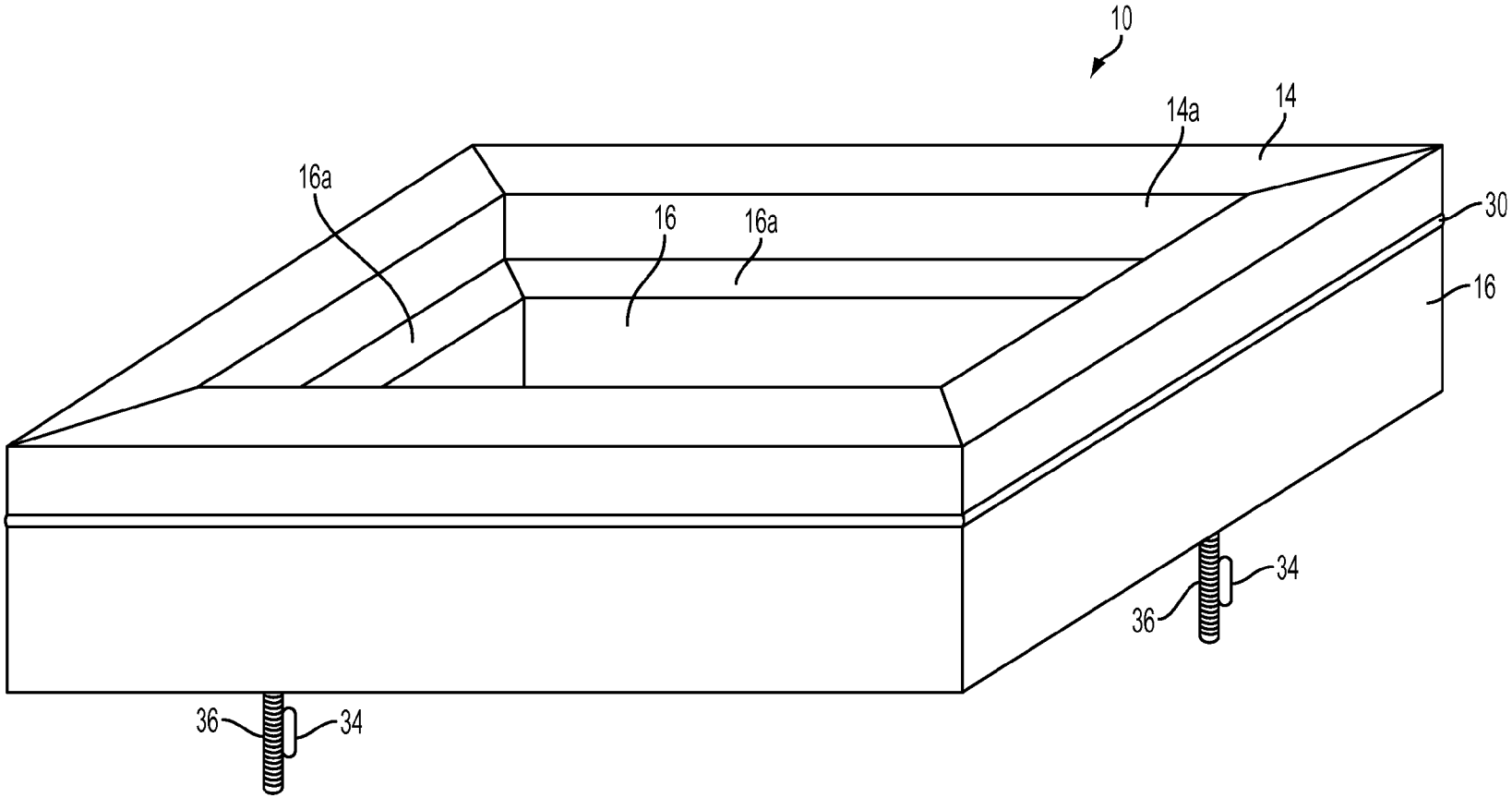
FIG. 4 shows a perspective view of the present invention shown in FIG. 1.

FIG. 4 shows a perspective view of the gravestone marker 10 without the display window 12 before the display window 12 is installed. The ledge 16*a* is sized in length and width to receive the display window 12. Once the display window 12 is installed, the display window 12 should remain in place permanently. The entire chamber formed including the concrete slab 38 should be hermetically sealed so that any objects contained therein are permanently preserved such as photographs or other ornate objects used to honor the deceased at the gravesite.

Figure 5:
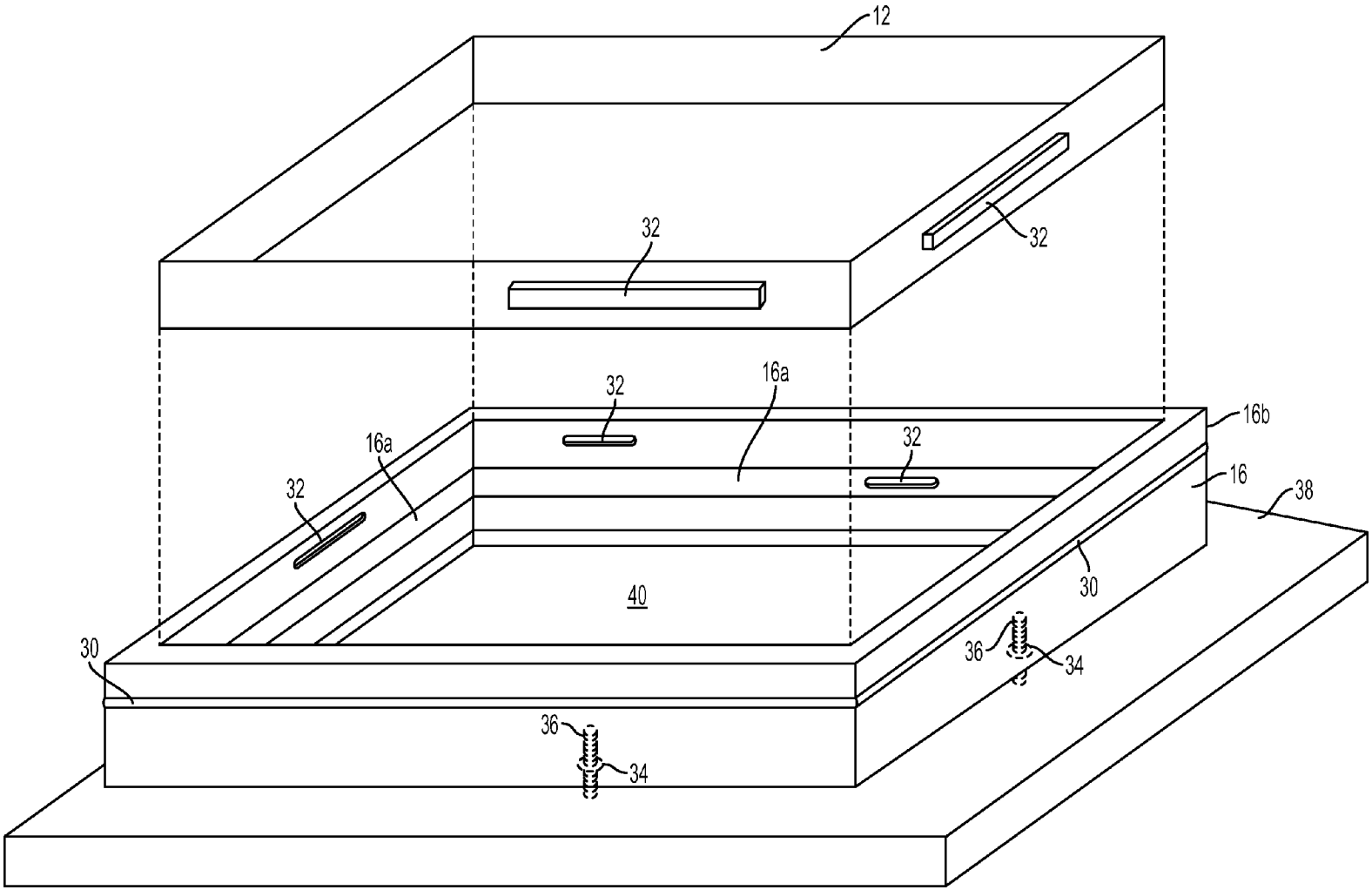
FIG. 5 shows a perspective exploded view of an alternate embodiment of the invention.

Referring now to FIG. 5 the gravesite marker viewing chamber 40 is shown in which the display window 12 which is made of bulletproof glass or plastic that is transparent is shown exploded as it would be mounted to a concrete frame 16*b* that is firmly attached concrete base frame 16 by adhesive 30. In fact the upper frame 16*b* and the concrete base frame 16 can be a single concrete piece that includes the support ledge 16*a*. Again the display window 12 is attached to the upper frame 16*b* and concrete base frame 16 by adhesive 32. The concrete base frame 16 is also attached to slab 38 by cylindrical rebar fasteners 36 using adhesive 34 applied in holes made in slab 38.

Figure 6:
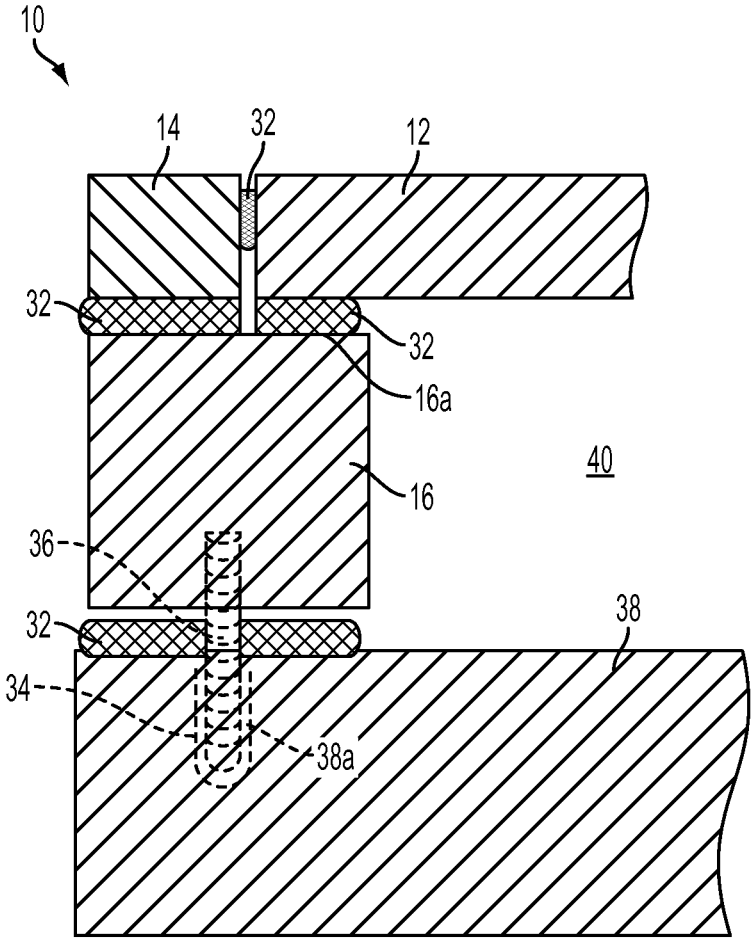
FIG. 6 shows a front elevational view in cross-section partially cutaway that shows the overall attachment of the elements of the invention.

Referring now to FIG. 6, the gravestone marker 10 is shown partially cutaway along one side and the relationship of how the slab 38 is connected to the concrete base frame 16 and the granite frame 14 and the glass sheet 12. The slab 38 includes rebar fastener 36 and adhesive 32 and adhesive 34 in hole 38*a* all of which attaches the slab 38 permanently to the concrete base frame 16. Granite frame 14 is attached by adhesive 32 along its bottom surface to a portion of the top surface of the concrete base frame 16. The glass sheet 12 sits on a ledge 16*a* and is attached by adhesive 32 to the concrete base frame 16 and to the side wall of granite frame 14 along its edge. The use of a concrete epoxy adhesive 32 and 34 ensures that the resulting chamber 40 will be hermetically sealed, waterproof, and watertight to permanently preserve any photographs and or memorabilia placed in chamber 40.

Figure 7:
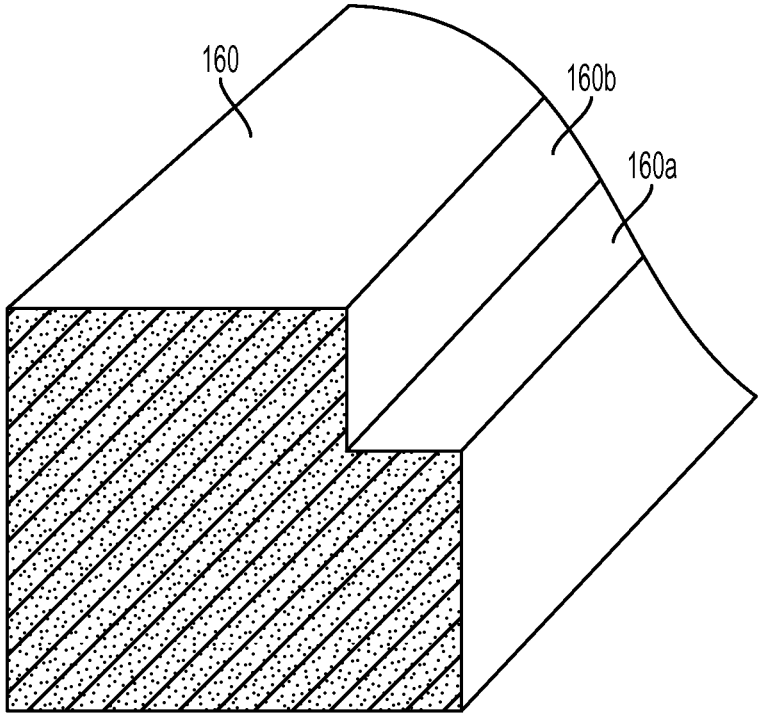
FIG. 7 shows a perspective cutaway view of the concrete base frame in cross-section in an alternate embodiment of the invention.

Referring now to FIG. 7, an alternate embodiment of the invention is shown in which the structure of the concrete base frame 160 has been altered to eliminate the granite frame previously shown. In this embodiment the concrete base frame 160 is a single solid piece of concrete that includes a ledge 160*a* and inside perimeter 160*b* that receives the glass sheet (not shown and concrete poly adhesive not shown to firmly mount the glass sheet which is the display window on the surfaces formed by ledge 160*a* and perimeter 160*b*. In this structure the concrete base frame is a single unit that gets adhesively anchored to the gravesite concrete slab (not shown in FIG. 7) as described above.

The present invention has been shown in its most preferred embodiment.

What I claim is:

1. A permanent gravestone marker having a protected viewing chamber for photographs and memorabilia comprising;

a concrete slab for a gravesite;

said concrete slab having a flat upper surface;

a rectangular concrete base frame having an upper surface and having a first elongated rectangular frame member, a second elongated rectangular frame member perpendicular to said first frame member, a third elongated rectangular frame member perpendicular to said second elongated frame member, and a fourth rectangular elongated frame member perpendicular to said third elongated frame member;

said concrete base frame, said first, second, third, and fourth elongated rectangular frame members joined together to form a concrete rectangular base frame, said concrete base first, second, third, and fourth, elongated rectangular frame members being the same width; said concrete rectangular base frame permanently attached to said flat upper surface of said concrete slab forming a rectangular viewing chamber;

a granite rectangular frame having first, second, third, and fourth elongated rectangular granite frame members joined together to form a rectangular granite frame, said first, second, third, and fourth elongated rectangular granite frame members being smaller in width than said concrete base frame elongated rectangular members and of equal length to said concrete base elongated rectangular frame members;

said rectangular concrete base frame having an exterior periphery in a rectangular shape and said granite rectangular frame having an exterior periphery rectangular in shape;

said rectangular granite frame connected to said concrete base frame member upper surface forming an L-shaped ledge between said granite rectangular frame and the upper surface of said concrete base frame and said rectangular concrete base frame exterior periphery being co-planar with said granite rectangular frame exterior periphery; and a rectangular sheet of transparent visually clear bullet proof material firmly connected to said granite frame and said concrete base frame along the L-shaped ledge formed by the rectangular granite frame and the rectangular concrete base frame, covering said viewing chamber.

2. A gravestone marker as in claim 1, including:

adhesive connected to and between said concrete base frame elongated members and said concrete slab; and adhesive connected to and between said concrete base frame elongated members and said granite frame members, and adhesive connected to and between said rectangular sheet of transparent material, said concrete base frame elongated members, and said granite rectangular elongated frame members for weather sealing and firmly holding said rectangular sheet of transparent material to said concrete base frame and said granite frame.

3. A gravestone marker as in claim 1, including:

threaded metal rebar connected to said rectangular concrete base frame elongated members and said concrete slab.

* * * * *